United States Patent [19]

Pillitteri

[11] 4,419,432

[45] Dec. 6, 1983

[54] DIAZOTYPE COMPOSITION STABILIZATION

[75] Inventor: Noreen J. Pillitteri, Spring Valley, N.Y.

[73] Assignee: Keuffel & Esser Company, Morristown, N.J.

[21] Appl. No.: 421,688

[22] Filed: Sep. 22, 1982

[51] Int. Cl.[3] ..... G03C 1/60

[52] U.S. Cl. ..... 430/179; 430/171; 430/177

[58] Field of Search ..... 430/177, 179, 171, 613, 430/428, 429, 372, 490

[56] References Cited

U.S. PATENT DOCUMENTS

| | | | |
|---|---|---|---|
| 2,374,563 | 12/1942 | Reichel | 430/177 |
| 2,429,249 | 10/1947 | Von Glohn et al. | 430/188 |
| 2,531,485 | 11/1950 | Von Glahn et al. | 430/179 |
| 2,727,820 | 12/1955 | Botkin et al. | 430/179 |
| 2,755,185 | 7/1956 | Sulich et al. | 430/179 |
| 3,255,007 | 6/1966 | Kosar | 430/179 |
| 3,453,112 | 7/1969 | Schaeffer | 430/179 |

OTHER PUBLICATIONS

Weiner et al., "Diazotype Papers", Institute of Paper Chem., Bibli. Series #220, Abstract #371 and 554.
Chemical Abstracts, vol. 65, #P10007e, 1966.
Chemical Abstracts, vol. 79, #151575y, 1973.
Chemical Abstracts, vol. 84, #P97845z, 1976.

*Primary Examiner*—Charles L. Bowers, Jr.
*Attorney, Agent, or Firm*—Lionel N. White

[57] ABSTRACT

Caprolactam, caprylolactam, and azacyclooctanone have been found to be equally effective as thiourea in stabilizing diazotype compositions and materials against pre-coupling, loss of shelf life, and dye image fading.

5 Claims, No Drawings

DIAZOTYPE COMPOSITION STABILIZATION

BACKGROUND

For many years diazotype compositions have included, in addition to the primary light sensitive diazonium salt component and azo coupler component, various adjuncts such as acidifiers, solubilizers, and stabilizers. Among these latter adjunct materials, thiourea has proved to be extremely versatile in stabilizing coating compositions and coated materials alike; to the extent, in fact, that it is utilized as a universal component in diazotype compositions.

More recently, however, thiourea and its use in numerous compositions, including diazotype formulations, has gained notoriety and come under the scrutiny of health and environmental agencies. As a result, there exists a definite danger that the continuation of this otherwise beneficial use of thiourea may be severely limited if not entirely curtailed. A substitute compound with the broad stabilizing utility of thiourea is thus clearly needed.

SUMMARY

While thiourea has long since been considered a nearly indispensable component in diazotype formulations, whether aqueous or solvent-based, the precise manner of its operation has even yet been unexplained. There is little doubt, however, that it functions to stabilize these formulations and compositions in all aspects of their use. In this respect the compound maintains the coating solutions in an optimum coatable state, prevents pre-coupling and loss of development rate in coated diazotype materials, and minimizes the deterioration of dye images in developed diazotype copies. Despite many years of investigation, the universal stabilizing role or thiourea has remained a fortuitious mystery.

The present discovery of a group of compounds which provide stabilizing effects in diazotype compositions as broad as those of thiourea is similarly surprising. While these compounds, which are principally heterocyclic ketones, bear no empirical resemblance to thiourea, they substantially duplicate its role in stabilizing diazotype compositions and materials. Further, they exhibit no deleterious properties and apparently pose no significant hazards in the eyes of health and environmental investigators.

These compounds, such as caprolactam, caprylolactam, and azacyclooctanone, may be directly substituted for thiourea as a stabilizing adjunct in diazotype compositions with a comparable extension in coating composition life, term of active developability, and fade resistance of azo dye images. They exhibit the ability to maintain these stabilizing effects in solvent-based as well as aqueous formulations.

DESCRIPTION

As a means of determining the stabilizing effects of thiourea on diazotype compositions and evaluating the efficacy of other compounds as stabilizers in such compositions, a series of pragmatic tests and procedures were implemented. These tests were applied to both aqueous and solvent diazotype compositions comprising representative compounds from substantially all the classes of diazonium and azo coupler components commonly utilized in commercial production. The results of these tests confirmed the essential role of the presence of thiourea or one of the newly discovered stabilizer compounds in useful diazotype products. The following tests were utilized in these evaluations:

Solution Stability

A diazotype coating solution must remain homogeneous throughout the term of the coating operation. To achieve this end, the solution is normally circulated through the coating system and is thus continually mixed by the actions of pumps, stirrers, and cascading flow. To duplicate this action, a solution under test was constantly agitated with mechanical stirrers over the period of ten hours which approximates the extent of a commercial coating run. Without an effective stabilizing adjunct numerous coating solutions, particularly those of aqueous composition, formed precipitates or pre-coupled, thereby rendering them useless.

Shelf Life

Coated diazotype compositions maintained in an atmosphere of 50% R.H. at about 50° C. for a period of 72 hours have been found to exhibit aging characteristics substantially equivalent to those resulting from storage at ambient conditions for several months. Lack of a stabilizer in such diazotype compositions results, upon aging, in significant precoupling of the composition components with consequent decrease in light sensitivity and image contrast. The extent to which particular compositions are so affected was determined by equally exposing to actinic light separate areas of coated material before and after accelerated aging, and subjecting those test areas to development processing. The degree of increase in background dye formation is indicative of the affect of the lack of shelf life stability in the composition.

Print Speed

The presence of an effective stabilizing compound generally improves the light sensitivity of a diazotype composition. The efficacy of such a compound may be established directly by use of any standard graded-density projection print scale to determine the optimum print speed of the coated material.

Development Rate

Rapid development of the azo dye image is likewise enhanced, particularly in two-component diazotype material, by the stabilizing compound. This effect was determined by means of commercially available diazotype exposure/development apparatus in which coated material was developed at its optimum print speed and the dye color density compared with that of a sample of the material which was developed to a maximum density in multiple passes through the apparatus.

Light Fastness

A stable dye image density in diazotype prints is an essential product property which is in great measure dependent upon an effective stabilizing compound. Such light fastness was determined by exposing a portion of a fully developed sample of the diazotype material to actinic light in numerous passes through the exposure/development apparatus. A comparison of the resulting dye color density with that of the unexposed portion of the sample was taken as an indication of the efficacy of the stabilizer in maintaining image density under prolonged ambient light exposure.

The foregoing tests were initially conducted on a broad range of commercial diazotype composition materials, coated from both aqueous and organic solvent formulations on paper and polymer film, in order to determine the general effect of the presence of thiourea in such formulations. A dramatic deterioration in one or more of the noted properties or characteristics was observed over substantially the whole of the range of the coated materials when the normally employed thiourea was eliminated from the various formulations. Aqueous compositions were particularly susceptible to precipitation, tar formation, or precoupling in the coating solution state when the thiourea was removed. Numerous of those remaining formulations which were capable of being coated deteriorated in print speed and rate of development after only about a week at normal storage conditions, and precoupled beyond practical limits upon accelerated aging. Significant background darkening and image dye fading were noted in most compositions as a result of the light fastness test.

The compositions which were examined in this manner comprised representative diazonium and coupler compounds from the major classes of such components utilized in commercial production. The diazonium compounds included p-phenylenediamine derivatives, such as 4-diazo-dimethylamino benzene, 4-diazo-diethylamino benzene, and 2-chloro-4-diazo-diethylamino benzene; p-heterocyclic phenyleneamine derivatives, such as 2-methyl-4-diazo-pyrrolidino benzene, 2,5-diethoxy-4-diazo-morpholino benzene, and 2,5-dibutoxy-4-diazo-morpholino benzene; and p-mercapto phenyleneamine derivatives, such as 2,5-dimethoxy-4-diazo-tolymercapto benzene and 2,5-diethoxy-4-diazo-tolylmercapto benzene.

These diazonium compounds were used along or in combination in compositions with likewise commercially employed azo coupler compounds including the broad classes of polyhydric phenol derivatives, such as resorcinol, diresorcylsulfide, mono-hydroxyethyl ether of catechol, and resorcyclic acid amide 1, 3, 4; acetamide derivatives, such as acetoacetanilide, acetoacetbenzylamide, and N,N'-ethylene-bis-acetoacetamide; and naphthol derivatives, such as 2,3-dihydroxy-naphthalene, 2,3-dihydroxy-naphthalene-6-sulfonic acid, 2-hydroxy-3-naphthoic acid-o-toluidide, 2-hydroxy-3-naphthoic acid morpholino propylamide, and 1-hydroxy-2-naphthoic acid morpholino propylamide.

Early attempts to stabilize these diazotype compositions by replacement of thiourea with less notorious thiourea derivatives, such as allylthiourea, ethylenethiourea, and $\beta$-hydroxyallythiourea, met with little success. The resulting compositions suffered from the same instabilities as did those devoid entirely of thiourea. Urea and its many derivatives similarly failed to provide the needed stability in the coating formulations and resulting sheet materials.

With the thiourea analogs providing no evident stabilization, it was surprising indeed to discover that the heterocyclic ketones, such as caprolactam, caprylolactam, and azacyclooctanone, effectively duplicated the action of thiourea in maintaining the broad range of commercially significant diazotype compositions in useful condition and with requisite properties over practical time spans. Each of these compounds, when substituted directly for thiourea in the formulations, resulted in coating solutions and coated sheets which successfully met the requirements of the noted test procedures. In some instances, such use of the lactam or azacyclo compound improved the performance of the material as compared with results obtained with thiourea.

In view of the fact that commerical diazotype compositions vary almost infinitely among manufacturers of these products, particularly with respect to the combinations of diazonium and azo coupler components, and the types and amounts of lesser, yet not inconsequential, adjuncts such as solubilizers, fillers, and the like, it would be impractical, if not impossible, to specify precise quantities of these new stabilizers which should be utilized to achieve optimum results. Suffice it to say, however, that in substantially all of the numerous compositions tested a direct weight-for-weight substitution of one of the heterocyclic ketones for the normally used thiourea provided satisfactory results. As with thiourea, the ratio may be within the broad range of about 10%–400% of the combined weight of the diazonium and coupler components, depending upon the fluid vehicle of the composition, other adjuncts employed, and the type of base material coated.

The following are typical examples of the formulations and testing procedures by which the efficacy of the stabilizer compounds was determined. In order to simplify these evaluations the compositions were prepared in their most rudimentary form, comprising simply the diazonium and azo coupler components in their usual molar ratios along with the acidifier and the stabilizer compound under examination. The remainder of each composition was limited to essential vehicle components.

EXAMPLE 1

Three coating solutions were prepared of the following formulations, the stated amounts being, as in all examples, parts of weight unless otherwise indicated:

| | A | B | C |
|---|---|---|---|
| Deionized water | 50.0 | 50.0 | 50.0 |
| Citric acid | 0.5 | 0.5 | 0.5 |
| Zinc chloride | 1.5 | 1.5 | 1.5 |
| Thiourea | 2.5 | — | — |
| Caprolactam | — | 2.5 | — |
| 4-diazo-dimethylamino benzene | 0.34 | 0.34 | 0.34 |
| N,N—ethylene-bis-acetoacetamide | 0.34 | 0.34 | 0.34 |

Portions of the resulting solutions were coated separately on commercial diazotype paper base stock using a no. 34 wire bar, and the sheets were subsequently dried at about 100° C. for three minutes. These coated sheets and the remaining portions of the solutions were subjected to the above-noted tests with the following results.

All solutions remained stable under the prolonged mixing conditions and were readily capable of being coated on the base stock. Coated samples A and B comprising the usual thiourea and new caprolactam stabilizers both indicated an optimum print speed of 12 at which both samples provided fully developed yellow images which exhibited good light fastness. Unstabilized control sample C, on the other hand, had a slower optimum print speed of 8 at which yellow image development was incomplete, requiring a number of passes through the developer section of the apparatus to achieve full color density. This resulting image, however, faded considerably under prolonged light exposure.

EXAMPLE 2

The following solutions were prepared for coating in the same manner as described in Example 1:

| | A | B | C |
|---|---|---|---|
| Deionized water | 50.0 | 50.0 | 50.0 |
| Citric acid | 0.5 | 0.5 | 0.5 |
| Zinc chloride | 1.5 | 1.5 | 1.5 |
| Thiourea | 2.5 | — | — |
| Caprolactam | — | 2.5 | — |
| 2-chloro-4-diazo-diethylamino benzene | 0.40 | 0.40 | 0.40 |
| Aceto-acetanilide | 0.27 | 0.27 | 0.27 |

Control sample C, without stabilizing compound, immediately precoupled and could not further be tested. Samples A and B, however, performed well in all tests and gave substantially identical results when coated as in Example 1. The sensitized sheets had an optimum print speed of 15 at which development of yellow images were rapid and complete. Coating mix and sheet aging stabilities were good.

EXAMPLE 3

Coating solutions were prepared as before, but using 0.37 parts of 4-diazo-diethylamino benzene and 0.38 parts of diresorcinol sulfide as the diazonium and coupler components. Unstabilized solution C remained fluid for a sufficient time to enable the preparation of coated sheet material, but with continued agitation the solution rapidly deteriorated to form a tarry sludge. All coated formulations provided material having image speed of 10; however, sample C exhibited poor development and image stability, while the remaining materials provided substantially equal, good results in all test categories.

EXAMPLE 4

Solutions were similarly prepared using 0.38 parts of 2,5-diethoxy-4-diazo-morpholino benzene and 0.39 parts of 2,3-dihydroxy-naphthalene-6-sulfonic acid as the diazonium and coupler components. As in the previous example, control formulation C suffered tar formation soon after preparation of speed 10 coated material which exhibited very poor development and image fastness. Although the stabilized samples, A and B, had good solution stability and provided coated material of speed 15, that containing caprolactam was significantly better in developing rate and light fastness than was the sample comprising thiourea.

EXAMPLE 5

Solvent-based sensitizing solutions were prepared of the following formulations, and were coated with a no. 30 wire bar on a commercially-available pre-treated polyethylene terephthalate polyester base film of about 75 μm thickness and dried at about 100° C. for three minutes.

| | A | B | C |
|---|---|---|---|
| Solvent (acetone/methanol, 50/50) | 50.0 | 50.0 | 50.0 |
| Cellulose acetate propionate | 4.5 | 4.5 | 4.5 |

-continued

| | A | B | C |
|---|---|---|---|
| Citric acid | 0.9 | 0.9 | 0.9 |
| Zinc chloride | 0.2 | 0.2 | 0.2 |
| Thiourea | 0.4 | — | — |
| Caprolactam | — | 0.4 | — |
| 4-diazo-diethylamino benzene | 1.28 | 1.28 | 1.28 |
| 2,3-dihydroxy-naphthalene-6-sulfonic acid | 1.05 | 1.05 | 1.05 |

The formulations and resulting speed 3 violet-imaging materials tested well but for the slow developing and poor light fastness of control sample C.

EXAMPLE 6

Substitution in Example 5 of 1.32 parts of 2-methyl-4-diazo-pyrrolidino benzene and 0.64 parts of 2,3-dihydroxy naphthalene for the diazonium and coupler components provided good coating solutions throughout, and good speed 7 blue-violet-imaging sheet material with stabilized A and B formulations. The speed 5 coating of the control developed poorly, however.

EXAMPLE 7

Similar substitution of 1.34 parts of 2,5 diethoxy-4-diazo-morpholino benzene and 1.11 parts of 2-hydroxy-3-naphthoic acid-o-toluidide resulted in speed 6 blue-imaging sheets of which only the caprolactam-stabilized sample B gave acceptable rapidly developing images of good light-fastness. Although better than the control, the thiourea material did not develop or age as well as sample B.

EXAMPLE 8

Likewise, compositions prepared by substitution of 1.32 parts of 2-methyl-4-diazo-pyrrolidino benzene and 1.24 parts of 2-hydroxy-3-naphthoic acid morpholino propylamide provided a speed 5 caprolactam-stabilized material which was by far superior to the thiourea sheet in both developing and light-fastness.

EXAMPLE 9

Five coating solutions were prepared of the following formulation:

| | |
|---|---|
| Solvent (methanol/2-methoxy ethanol, 3/1) | 82. |
| Cellulose acetate propionate | 11. |
| 5-sulfosalicylic acid | 0.5 |
| Zinc chloride | 2.0 |
| Resorcylic acid amide 1,2,4 | 0.4 |
| Mono-hydroxyethyl ether of catechol | 1.3 |
| 2,5-dimethoxy-4-diazo-tolylmercapto benzene | 1.6 |
| 2,5-dibutoxy-4-diazo-morpholino benzene | 0.4 |

To each of four of the solutions was added 0.8 parts of thiourea, caprolactam, caprylolactam, and azacyclooctanone, respectively, the remaining solution being retained in its original state as a control. The resulting solutions were individually coated on 75 μm polyester films using a no. 20 wire bar and dried at about 85° C. for three minutes. The solutions and coatings were then tested in the manner described above.

As was previously observed, solvent-based compositions are generally more tolerant of the extended agitation of the solution stability test than aqueous composition. This held true in the present example, but was the only test which the unstabilized control material did not fail. Immediately after coating, all sample gave substantially equal speed 12 sepia images, but the unstabilized control rapidly deteriorated within a few days to speed 8 which required several development passes for acceptable image density. The lightfastness of the control images dropped rapidly and considerable background discoloration occurred during the test. By the end of the shelf life test period the control samples had precoupled to an unusable state. Throughout all tests, on the other hand, the stabilized samples were substantially equal in all respects, the caprolactam, caprylolactam, and azacyclooctanone displaying stabilizing efficacy equivalent to that of thiourea.

EXAMPLE 10

The efficacy of these stabilizing compounds was further displayed with more dramatic results during the preparation of the following black-imaging composition which was not possible to maintain as a workable coating solution without the addition of a stabilizer. As in the previous example, the primary solutions were made of the following formulation and 1.0 parts of thiourea, caprolactam, caprylolactam, and azacyclooctanone were added to each, respectively, as the stabilizer.

| | |
|---|---|
| Solvent (methanol/2-methoxy ethanol, 85/15) | 83.4 |
| Cellulose acetate propionate | 9.1 |
| Tartaric acid | 2.3 |
| Boric acid | 0.4 |
| Zinc chloride | 0.6 |
| 2,3-dihydroxy-naphthalene-6-sulfonic acid | 0.5 |
| 2,3-hydroxy naphthoic acid morpholino propylamide | 0.7 |

-continued

| | |
|---|---|
| 1,2-hydroxy naphthoic acid morpholino propylamide | 0.7 |
| Acetoacetbenzylamide | 0.4 |
| 4-diazo-diethylamino benzene | 1.2 |
| 2-methyl-4-diazo-pyrrolidino benzene | 0.9 |

Coatings of the stabilized solutions on the polyester base under the conditions of the previous example produced speed 8 imaging film materials which performed well throughout the test procedures, the stabilizing compounds of the present invention being as effective as the thiourea in maintaining the desirable properties of the diazotype materials.

What is claimed is:

1. Diazotype material comprising a light-sensitive diazonium compound, an azo coupler compound, and a stabilizing amount of a compound selected from the group consisting of caprolactam, caprylolactam, and azacylooctanone.

2. Material according to claim 1 wherein said stabilizing compound is present in an amount which is between about 10% and 400% of the combined weight of said diazonium and coupler compounds.

3. Material according to claim 1 or 2 which comprises an intimate mixture of said diazonium, azo, and stabilizing compounds.

4. Material according to claim 3 wherein said intimate mixture further comprises an effective amount of a suitable acidifier.

5. Material according to claim 4 wherein said intimate mixture comprises a composition coated on at least one surface of a suitable sheet support.

* * * * *